US005734626A

United States Patent [19]

Eckstein

[11] Patent Number: 5,734,626

[45] Date of Patent: Mar. 31, 1998

[54] SYNCHRONISATION DEVICE COMPRISING A TIME ZONE DETECTOR

[75] Inventor: Doris Eckstein, Solothurn, Switzerland

[73] Assignee: ETA SA Fabriques D'Ebauches, Grenchen, Switzerland

[21] Appl. No.: 700,095

[22] Filed: Aug. 20, 1996

[30] Foreign Application Priority Data

Aug. 22, 1995 [CH] Switzerland ..... 02 393/95

[51] Int. Cl.[6] ..... G04B 19/22

[52] U.S. Cl. ..... 368/21; 368/187

[58] Field of Search ..... 368/76, 187, 243–251, 368/272, 273, 21–27

[56] References Cited

U.S. PATENT DOCUMENTS

| | | | |
|---|---|---|---|
| 4,253,173 | 2/1981 | Jaunin | 368/76 |
| 4,536,093 | 8/1985 | Yoshida | 368/187 |
| 4,712,926 | 12/1987 | Tanabe | 368/251 |

FOREIGN PATENT DOCUMENTS

| | | |
|---|---|---|
| 1557667 | 9/1967 | France . |
| 2148558 | 5/1985 | United Kingdom . |
| 2217914 | 11/1989 | United Kingdom . |

*Primary Examiner*—Bernard Roskoski
*Attorney, Agent, or Firm*—Sughrue, Mion, Zinn, Macpeak & Seas, PLLC

[57] ABSTRACT

The invention concerns a synchronisation device for synchronising the analogue display with the digital display of a timepiece.

The device includes a contact wheel (1), driven by the hour-wheel of the timepiece, on which is fixed a contact spring (2) with several arms (4, 6; 8, 10). The arms make contact with conductive strips (T1–T5) distributed according to a particular arrangement on a printed circuit board associated with the device according to the invention. Via the geometry of the arms, the strips are periodically connected in different configurations. The series of combinations forming the possible different configurations is repeated periodically. The device further comprises an electronic control signal generating device for storing the initial position corresponding to a certain configuration of the contacts. Since the series of combinations is given, each movement of the hour-wheel can be detected.

7 Claims, 3 Drawing Sheets

SYNCHRONISATION DEVICE COMPRISING A TIME ZONE DETECTOR

BACKGROUND OF THE INVENTION

The present invention concerns a synchronisation device for an electronic timepiece comprising an analogue display for displaying certain time information and an electronic counter for storing certain of said time information, such synchronisation device being intended to synchronise the display with the counter. More specifically, the invention concerns a device of this type for a timepiece having combined digital and analogue displays, the synchronisation device being intended to synchronise such displays in the event of a time zone change.

Such a synchronisation device has already been proposed. Indeed, patent application FR-A-2 484 101 concerns a timepiece comprising a synchronisation device which includes a wheel bearing the minute or second hand on which two conductive thin strips rub. Electric contact means are provided on one face of the wheel for periodically raising and thus short-circuiting the two thin strips.

However, if the wheel is rotated rapidly, mechanical bounces may occur thus impeding the short-circuit. Furthermore, the detection precision and the correction which can still be effected to compensate any loss of information due to the bounces, are very limited.

Patent CH-B-653 846 also discloses a synchronisation device for a timepiece, enabling, in the event of a change of date, an analogue display to be synchronised with an electronic counter contained within the timepiece. Here, the synchronisation device comprises a first cam having an annular shape which is situated around the pipe of the hour-wheel. A conductive thin strip, mounted on the flat annular part of the cam, has a slanted tip which extends towards a conductive strip connected to the electronic device of the timepiece. Three spacer studs are placed in the plate of the cam and are distributed in a circular manner in positions at 120°. When the projecting studs are facing notches arranged in a second rotating cam situated below the first cam, the first cam bearing the studs will be moved downwards through the effect of a washer made of thin metal and which "jumps back", i.e. its convexity changes its direction when one tries to flatten it. The conductive thin strip is thus driven towards the conductive strip. Such an arrangement also has the problem that, because of the movement of the first cam with the conductive thin strip, mechanical bounces occur when the second cam bearing the notches rotates rapidly leading to a loss of information without the possibility of compensation or correction. Further this system is difficult to adapt to detect time zone changes.

SUMMARY OF THE INVENTION

An aim of the present invention is to overcome these disadvantages of the prior art via a new and inventive solution which is defined in the claims.

The synchronisation device proposed by the invention consists of a "pseudo-absolute" co-ordinate system, i.e., by knowing the starting position, the position of the hand indicating the time information may be found with greater precision because of a superabundance of information.

For this purpose, the hour-wheel drives a contact wheel on which is fixed a contact spring with several arms. The arms make contact with the conductive strips distributed according to a particular arrangement on the printed circuit board associated with the synchronisation device and with an electronic device for generating control signals. Via the geometry of the arms, the strips are periodically connected in different configurations, for example every twenty minutes. The series of combinations forming the possible different configurations is periodically repeated. The electronic control signal generating device, for example a microprocessor, stores the initial position corresponding to a certain configuration of the contacts, and, as the series of combinations is given, each movement of the hour-wheel of, for example, twenty minutes, can be detected.

As a result of the features of the invention, the synchronisation device can better detect the changes of states while necessitating less space for the electronic circuit connected to the device. Thus, the space requirement, which is important insofar as the synchronisation device is used in a timepiece, in particular a wristwatch, may remain minimal.

Other advantages and features of the invention will appear more particularly from the following description in which an embodiment of the subject of the invention is described, solely by way of example, with reference to the attached drawings, in which:

DESCRIPTION OF A PREFERRED EMBODIMENT

Figure 1:
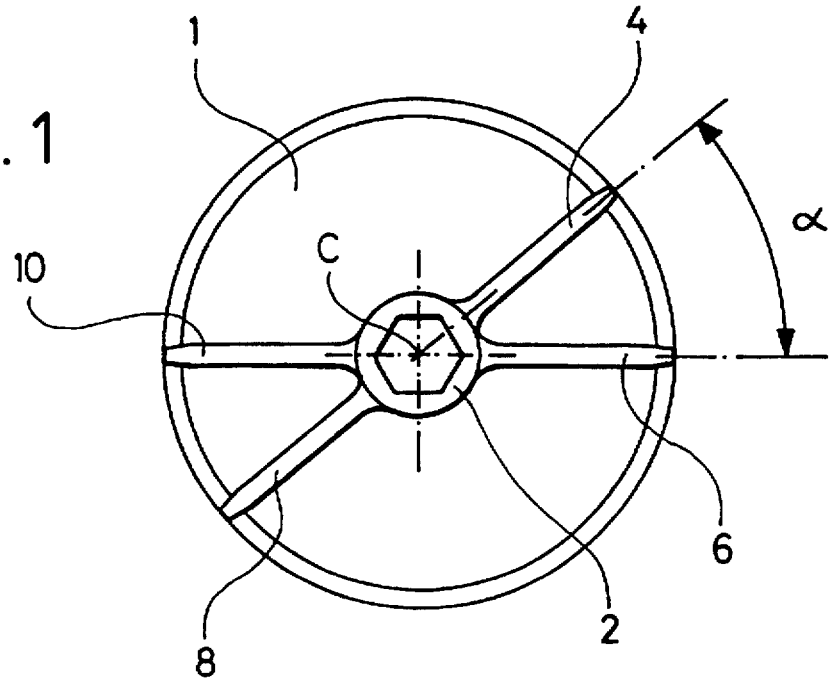
FIG. 1 shows schematically a top view of a contact wheel comprising a contact spring having conductive arms of the synchronisation device according to the invention.

FIG. 1 shows a contact wheel 1 of the synchronisation device D according to the invention. Device D according to the invention is intended to be used in a timepiece for synchronising the digital display of a time zone with the analogue display of the current time. A contact spring 2, having in this example four arms, 4, 6, 8 and 10, is fixed onto contact wheel 1. Wheel 1 has a centre C situated on its axis of symmetry and is associated with a gear-train of the timepiece. Wheel 1 is arranged to be driven by the hour-wheel of the timepiece, which is not shown. In the example, the contact wheel is a twelve hour wheel, but this wheel may also be a twenty-four hour wheel. The manner of driving wheel 1 by the clockwork gear can be effected in a way known to the man skilled in the art, which will not be described in detail here.

Figure 2:
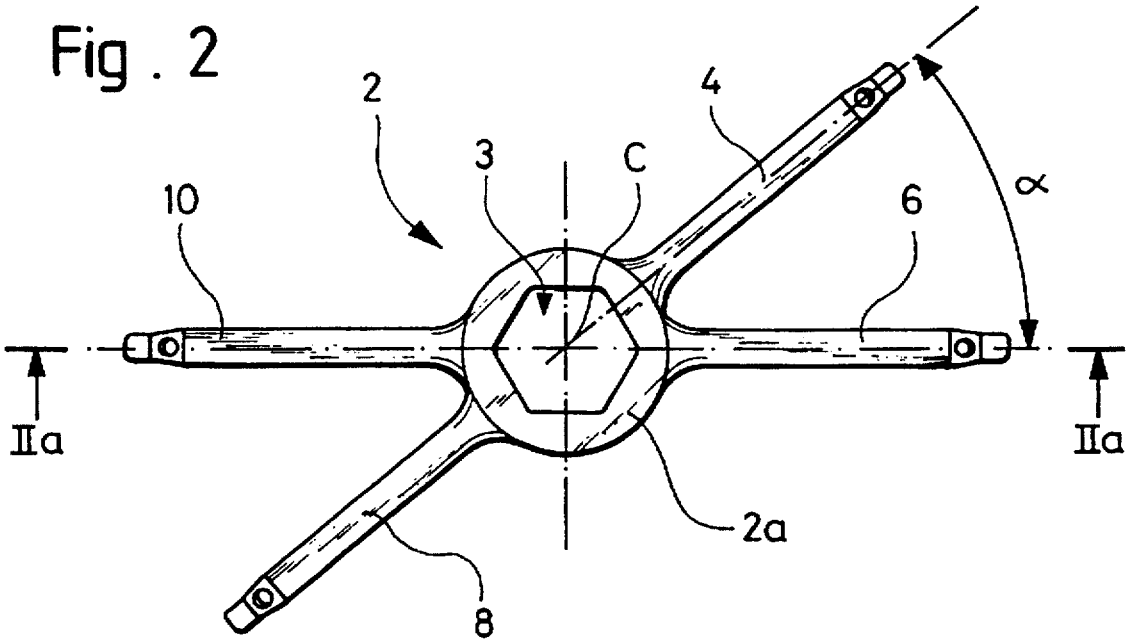
FIG. 2 shows in more detail the contact spring with its conductive arms of FIG. 1.

Contact spring 2 is mounted axi-symmetrically in relation to wheel 1 at centre C of the latter, and is shown in more detail in FIG. 2. Spring 2 is made of a conductive material and here comprises two pairs of arms 4, 6 and 8, 10 which extend longitudinally from centre C outwards, with an angle of symmetry Ω which is here 180°. However, spring 2 may comprise several pairs of arms enjoying the same geometries. Angle of symmetry $\Omega$ thus depends upon the number of pairs of arms. The symmetries would then change to 120° for three pairs, to 90° for four pairs and so on. Spring 2 includes a hub 2*a* having a central opening 3 centred on point C enabling spring 2 to be assembled on contact wheel 1 in a way which is also known to the man skilled in the art.

Figure 2A:
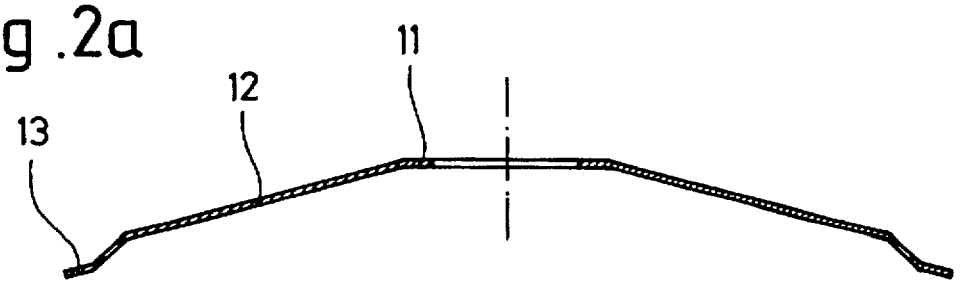
FIG. 2*a* shows a schematic cross-section of a conductive arm of the contact spring of FIG. 2.

FIG. 2*a* shows a cross-sectional view of an arm of spring 2 of FIG. 2. Pairs of conductive arms 4, 6 and 8, 10 are electrically connected to each other by means of hub 2*a*. Each arm is identical to the others. In this example, each arm 4, 6, 8, 10, only one of which is shown in FIG. 2*a*, has three different portions. A first portion, referenced 11, forms together with the other first portions of the other arms, hub 2*a*. This internal portion 11, extending from the centre of spring 2, is associated with a second central portion 12 which is, preferably, slightly sloped in relation to first portion 11. A third portion 13 forms the free end of the arm and is also, preferably, sloped in relation to central portion 12 of the arm. However, it is understood that second portion 12 and free end 13 may be replaced by a single portion having a slope equal to the total slope of the two portions 12 and 13. Free end 13 has a slanted tip which extends towards a contact strip to enter into friction contact with the latter as will be explained in more detail hereinbelow.

The two arms of a same pair are staggered at an angle $\alpha$. The two pairs of arms of the embodiment described here are arranged symmetrically in relation to centre C. Angle $\alpha$ is 40° in this example, but it may also be chosen differently. Indeed, the conditions to be fulfilled by the arrangement of the arms, and thus the boundary values of angle $\alpha$, depend upon the arrangement of the contact strips as will also be explained in more detail hereinbelow.

Figure 3:
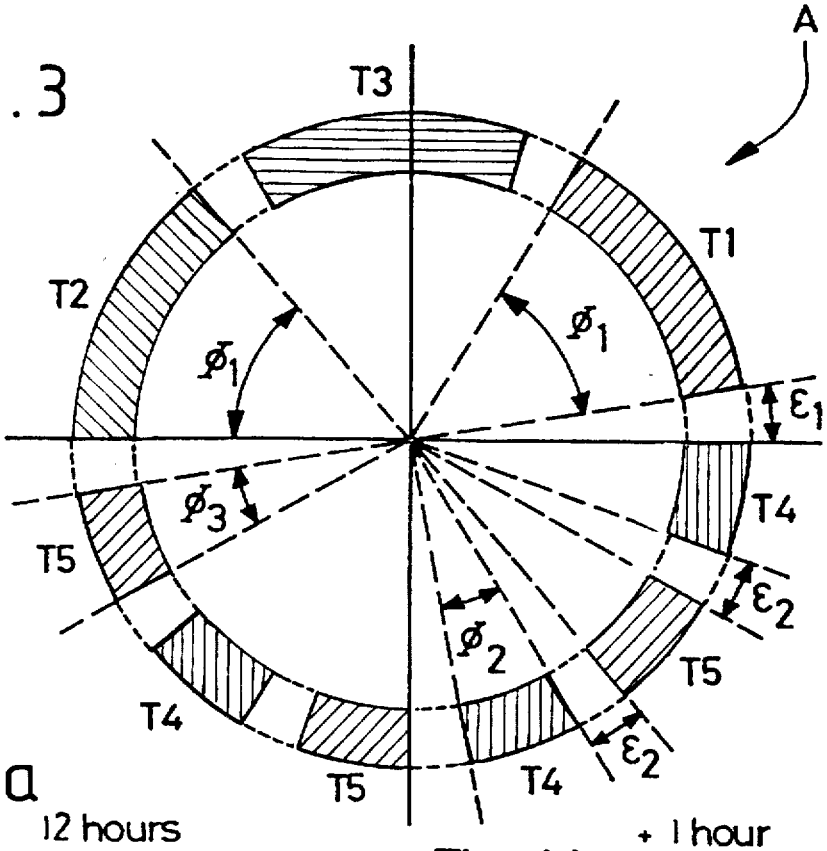
FIG. 3 shows schematically the arrangement of the contact strips on a printed circuit board arranged under the contact wheel of FIG. 1.

The contact strips are shown schematically in FIG. 3. The strips are deposited, by a method well known to the man skilled in the art, on a printed circuit board arranged below contact wheel 1 of FIG. 1. The circuit is associated with synchronisation device D according to the invention so that the latter is connected to an electronic control signal generating device P, for example a microprocessor, intended to receive electric pulses which are generated when arms 4, 6, 8, 10 come into contact with the contact strips.

The strips form contact areas arranged in a circular manner and define thus a ring A. As is seen in FIG. 3, ring A comprises several different areas, here three sorts of different areas T1 or T2 or T3 and T4 and T5 which are each separated from the other by a separating space having an angle at the centre $\epsilon$. The length of a strip is defined by the angle at the centre $\phi$. The sum of the length of a strip and the separating space is also defined as the angle of repetition $\gamma$, thus $\gamma=\phi+\epsilon$.

FIG. 3 shows three distinct first contact areas, called detection areas, referenced T1, T2 and T3, each having a length $\phi_1$ which in this example is approximately 50°, thus $\phi_1>\alpha$. The distance between each of these detection areas is $\epsilon 1$ which in this example is approximately 10°. First contact areas T1, T2, T3 are regularly distributed on a first half (180° ) of ring A.

Ring A further comprises on its other half, called the second half, three second and three third contact areas, referenced T4 and T5. The length of each of second areas T4 is $\phi_2$, and of each of third areas T5 is $\phi_3$. $\phi_2$ and $\phi_3$ are here approximately 20°, thus $\phi_2=\phi_3<\alpha$. Areas T4 and T5 are separated from each other by a distance $\epsilon_2$, here approximately 10°. Second contact areas T4 are regularly distributed on the second half of ring A. Such areas T4 also function as detection areas, but they may also function as power supply areas as will be explained in more detail hereinbelow. Third contact areas T5 are also regularly distributed on the second half of ring A. Third areas T5 are power supply areas which, together with one of contact areas T1, T2, T3 or T4, generate a pulse at the moment when conductive arms 4, 6, 8, 10 enter into friction contact with the areas, as will be explained in more detail hereinbelow. In the embodiment shown in FIG. 3, third contact areas T5 are distributed alternately vis-à-vis contact areas T4.

As the arms are arranged symmetrically, in this example, at 180°, angle of repetition $\gamma$ must be repeated an integer number m of times in angle of symmetry $\Omega$, which is here 180°. Thus the following conditions are obtained:

$$\text{if } \phi \geqq \alpha\text{: } m\cdot\gamma=\Omega\text{, and}$$

$$\text{if } \phi<\alpha\text{: } 2m\cdot\gamma=\Omega,$$

as there are second and third contact areas. Such parameter m corresponds to the number of phases, or hours, in the duration of a contact, as will be explained hereinbelow. FIG. 3 shows the example with $\Omega=180°$ and where m=3, thus where there are three strips of a same contact on one half of ring A, namely for the first areas there are three contacts T1, T2 and T3 on the first half, and on the second half of ring A there are six contacts, for the second areas there are three contacts T4, and for the third areas there are three contacts T5.

The particular arrangement of strips T1 to T5 relative to arms 4, 6, 8 and 10 enables an extension of the contact duration between an arm and a strip to be obtained. Thus, the detection resolution is improved. Such extension depends upon the angles selected. In general it can be said that the following two conditions are valid:

$$\text{for } \phi<\alpha\text{: } \alpha=n\cdot\gamma-\phi=(n-1)\cdot\phi+n\cdot\epsilon \quad (1);$$

$$\text{for } \phi\geqq\alpha\text{: } \alpha=m\cdot(\gamma/(m-1))-\phi\text{, where } m>2 \quad (2);$$

Parameter (n−1) corresponds to the number of contact areas between two arms, i.e. in angle $\alpha$. For condition (1), it is understood that when this condition is fulfilled, the length of the electric contact is extended to $2\cdot\phi$, and for condition (2), the length of the electric contact is extended to $(\alpha+\phi)$. Thus, for the example given, in which 10° corresponds to twenty minutes, as will be explained in more detail hereinbelow, the length of the contact is 40+50=90°. As this corresponds to three hours, parameter m has the value "3". In FIG. 3, it is seen that $\phi_1>\alpha$, and that $\phi_2=\phi_3<\alpha$. For the example given, $\phi_1$ must thus fulfil condition (2), while $\phi_2$ and $\phi_3$ must fulfil condition (1). Thus one obtains n=2 and m=3.

The operation of synchronisation device D is as follows.

The assembly of arms 4, 6, 8, 10 and contact areas T1 to T5 form a time zone detector of synchronisation device D according to the invention. The change from one time zone to another is carried out by the user in a known manner, for example by pulling out the stem of the timepiece comprising device D according to the invention to then advance the analogue display, for example the hour hand. The analogue display is set to the time selected by the user, and the digital display of the time zone, which shows for example only the figure of the corresponding time, must thus be synchronised with the modified analogue display by synchronisation device D according to the invention.

For this purpose, the electronic control signal generating device, such as a microprocessor P, reads the position co-ordinates of contact wheel 1 at the moment when the stem of the timepiece is pulled out to modify the analogue display. Thus the configuration of the states of the pulses generated is stored. The analogue and digital displays must be synchronised. By changing the analogue display, the position of contact wheel 1 is thus modified in a corresponding manner. Arms 4, 6, 8, 10 will generate a series of pulses when they enter into contact with contact strips T1 to T5. These pulses together form codes giving information corresponding to the time-related data provided by the analogue display.

The duration of a state defines the detection resolution and thus depends upon the geometry of the arms and the contact strips. For example, for the geometry shown in FIGS. 1 and 3, the strips will be connected in different configurations every twenty minutes, which corresponds to a movement of ten degrees. However, it is understood that for a different geometry to the one shown here, a change of state may last more or less than twenty minutes or ten degrees. The resolution is determined by the desired result considering the physical and electronic restrictions of the synchronisation device, such as the available space and power consumption of the electronic circuits.

In this example, contact wheel 1 is a twelve hour wheel. Since the arms, which are associated with contact wheel 1, have a symmetrical geometry, the series of signals generated, i.e. the possible different configurations, will be repeated every six hours (180°). In the example, one would also like to detect a change of state every twenty minutes. For this, three states per hour are needed, and eighteen states in total. This thus necessitates five different contacts ($2^5$= 32>18).

FIG. 4 shows schematically several combinations of the arms of contact spring 2 with strips T1 to T5. The starting position in this example is twelve o'clock (midday). It is seen that in this case strips T3 and T5 are connected to each other (FIG. 4*a*). If the position of the analogue display is advanced by one hour, strips T1, T3 and T4 will be connected (FIG. 4*b*). By advancing another hour, strips T1 and T5 will be connected (FIG. 4*c*), and after another hour, it is strips T1, T2 and T4 which are connected to each other (FIG. 4*d*).

Figure 5:
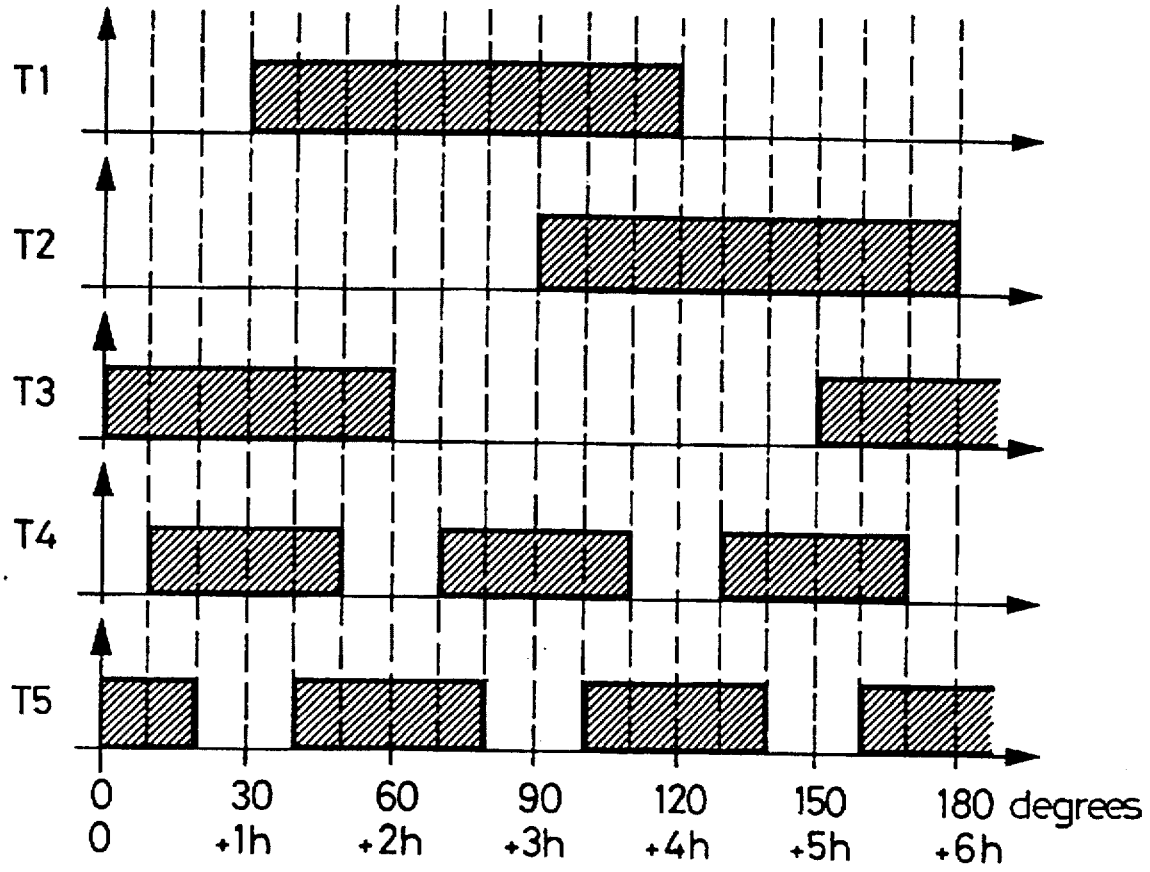
FIG. 5 shows schematically the series of the eighteen possible contact combinations.

FIG. 5 shows schematically the series of eighteen possible contact combinations for the example described hereinabove. It is seen that every ten degrees there is a change of state. The combination T1=0 and T2=0 and T3=0 is considered as indicating an error of device D.

Figure 4A:
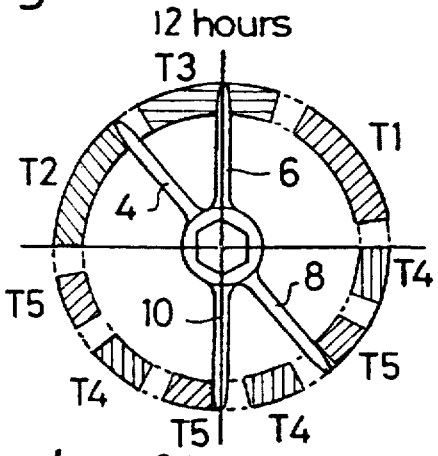
FIG. 4 shows schematically the combinations made between the contact spring and the contact strips.
Figure 4B:
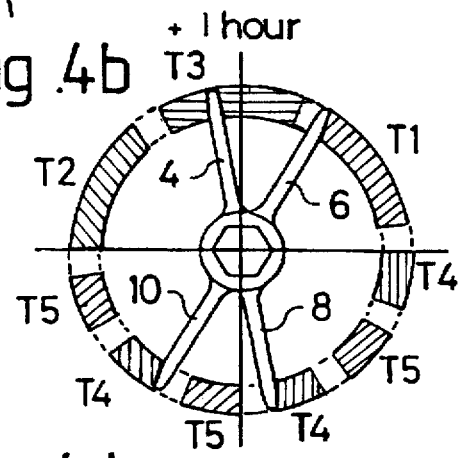
Figure 4C:
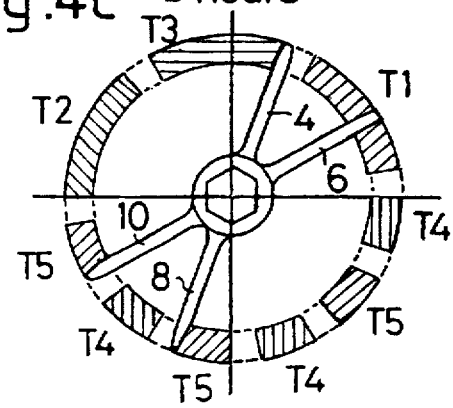
Figure 4D:
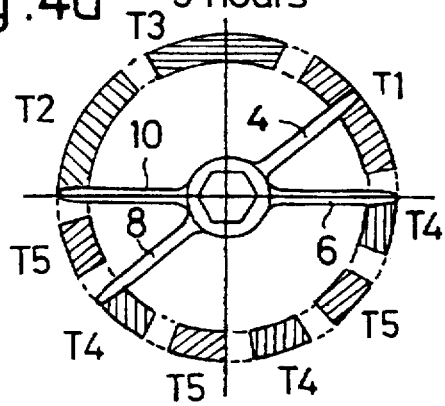

In order for microprocessor P to be able to read the states of input contacts T1, T2, T3, the latter must be power-supplied, i.e. a connection is required between a detection input contact T1, T2 or T3, and power supply contact T5. For this purpose, strip T5 is set to a supply voltage Vdd, thus T5=Vdd. However, as can be seen in FIG. 4*b* or 4*d*, strip T5 is not always connected to the other strips. In this case, it is strip T4 which takes the role of power supply strip. In fact, T4 is generally switched as an output, and is set to voltage Vdd. T4 is switched as an input solely during the moment when microprocessor P is reading. To achieve this, contact T4 is connected to an input/Output (I/O) gate of microprocessor P. If T4 is not at voltage Vdd, strip T5 is not contacted. Thus contact T5 is used as a "pseudo-input" as a result of which the five contacts necessary for detecting the 18 states are obtained.

As a result of the particular use of contact T4 the detection resolution is increased without requiring additional strips increasing the space requirement of device D according to the invention. It is understood that there are thus three different possibilities for supplying the contacts, i.e. via T4 and T5, via T5, or via T4.

In an advantageous manner, the electric contacts can be described by hexadecimal figures. By giving "high" state T1 the value "4", "high" state T2 the value "2", "high" state T3 the value "1", "high" state T4 the value "2", and "high" state T5 the value "1", the eighteen possible states are as follows (still according to FIGS. 4 and 5):

| state no. | 1 | 2 | 3 | 4 | 5 | 6 | 7 | 8 | 9 |
|---|---|---|---|---|---|---|---|---|---|
| T1 + T2 + T3 | 1 | 1 | 1 | 5 | 5 | 5 | 4 | 4 | 4 |
| T4 + T5 | 1 | 3 | 2 | 2 | 3 | 1 | 1 | 3 | 2 |
| state no. | 10 | 11 | 12 | 13 | 14 | 15 | 16 | 17 | 18 |
| T1 + T2 + T3 | 6 | 6 | 6 | 2 | 2 | 2 | 3 | 3 | 3 |
| T4 + T5 | 2 | 3 | 1 | 1 | 3 | 2 | 2 | 3 | 1 |

The control signal generating device further comprises means for analysing the states read by microprocessor P. Of course, this analysis must react reasonably to each movement.

Figure 6A:
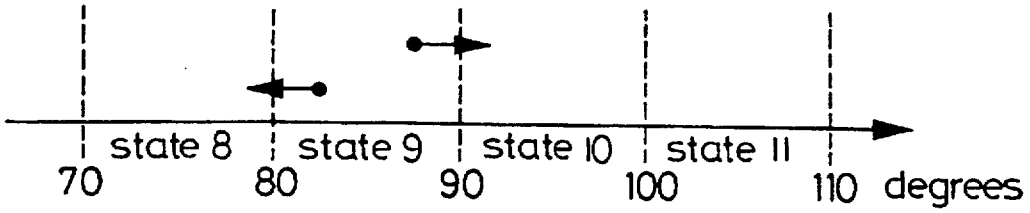
FIG. 6 shows a diagram of changes of state of the analogue display starting from an initial state.
Figure 6B:
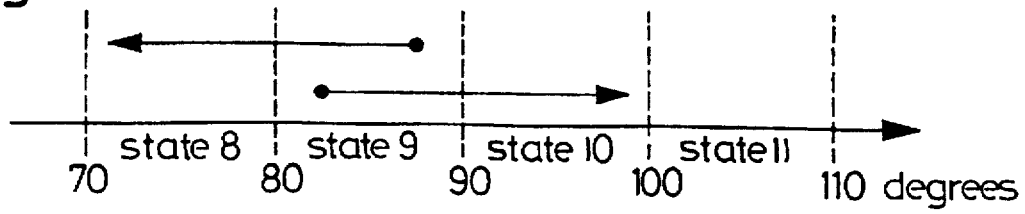

FIG. 6 shows a diagram of changes of state of the analogue display starting from initial state no. "9". It is understood that the digital display does not necessarily have to change with every movement of the analogue display. If for example state 9 is read and then stored by microprocessor P, states 8 or 10 may just be a very small movement of the hour hand of the analogue display, see FIG. 6*a*. A single change of one state is thus not considered as a defined movement. The stored state then remains the old state. At worst, movements of almost forty minutes or almost twenty degrees are thus not accepted as a jump of the hour hand necessitating a synchronisation of the digital display, see FIG. 6*b*.

In fact, as the change of one hour corresponds in principle to three changes of state of twenty minutes, the movement of a change of one hour which is detected and which necessitates a synchronisation of the displays, corresponds to a change of two to four states, depending upon the starting position of the hour hand. The minimum angle which is considered as a jump of one hour would thus be a little more than forty minutes or twenty degrees. At worst, the maximum angle then comprises a little less than 100 minutes or 50 degrees.

By analogy, a jump of two hours of the hour hand of the analogue display can be analysed. A movement or a jump of two hours which must be detected thus corresponds to a movement of five to seven states. The minimum angle which is considered as a two hour jump would thus be a little more than eighty minutes or forty degrees. The maximum angle considered as a two hour jump will comprise a little less than 160 minutes or 80 degrees.

It is to be noted that a change of more than seven states cannot be correctly interpreted because of uncertainty as to the direction of the movement. Indeed, even if it is clear that such a change will correspond to a jump of three hours, one knows that the detection of three hours corresponds to a change of eight to ten states. However, a change of ten states cannot be detected, because the determination of the direction in which the hour hand will have moved is not possible.

Of course, the invention is not limited to the particular embodiment described hereinabove, which is given solely by way of non-limiting example in relation to the subject of the invention.

What is claimed is:

1. A synchronisation device in combination with an electronic timepiece which comprises a time base, a gear-train, an analogue display driven by said gear-train for displaying time information, and an electronic counter for storing certain of said information, said synchronisation device synchronising said display with said counter, and comprising:

a contact wheel driven by said gear-train, and having at least two pairs of conductive arms electrically connected to each other and which extend longitudinally from the axial centre of such wheel towards contact areas situated on an electronic circuit board arranged below said wheel, said pairs of arms arranged symmetrically in relation to said centre with an angle of symmetry $\Omega$ between each pair, the two arms of a same pair being staggered at an angle $\alpha$;

an electronic control device connected to said circuit board and associated with said synchronisation device;

said contact areas being arranged in a circular manner and defining a ring, the length of each of said areas having an angle at the centre $\phi$, said areas being separated from each other by an angle at the centre $\epsilon$, and having an angle of repetition $\gamma=\phi+\epsilon$, the angle of repetition $\gamma$ being repeated an integer number m of times in the angle of symmetry $\Omega$ when $\phi\geqq\alpha$, and the angle of repetition $\gamma$ being repeated an integer number 2m of times in the angle of symmetry $\Omega$ when $\phi<\alpha$, and comprising m distinct detection first contact areas being regularly distributed on a first half of said ring, and having a length $\phi_1$ which is greater or equal to said angle $\alpha$, and m second and m third distinct contact areas being regularly and alternately distributed on a second half of said ring, each second areas having a length $\phi_2$ and each third area having a length $\phi_3$, such lengths $\phi_2$ and $\phi_3$ being less than said angle $\alpha$, in order to connect two strips with said arms.

2. The combination according to claim 1, wherein said hour-wheel is a twelve hour wheel making one rotation in twelve hours.

3. The combination device according to claim 1, wherein said hour-wheel is a twenty-four hour wheel making one rotation in twenty-four hours.

4. The combination device according to claim 1, wherein the angle $\alpha$ at which the two arms of a same pair are staggered is forty degrees.

5. The combination device according to claim 1, wherein said arms constitute a contact spring mounted axisymmetrically in relation to said hour-wheel.

6. The combination device according to claim 1, wherein each arm has a free end which is sloped in relation to the plane in which said hour-wheel is situated.

7. The combination device according to claim 1, wherein said second contact areas are connected to an input-output gate of said electronic control device for operating both as detection areas and as power supply areas.

* * * * *